US006018283A

United States Patent [19]

Kyhl et al.

[11] Patent Number: 6,018,283

[45] Date of Patent: Jan. 25, 2000

[54] ULTRAWIDE BANDWIDTH Z-AXIS INTERCONNECT

[75] Inventors: Cary Kyhl, Grapevine, Tex.; Thomas P. Budka, Shirley, Mass.

[73] Assignee: Texas Instruments Incorporated, Dallas, Tex.

[21] Appl. No.: 08/992,121

[22] Filed: Dec. 17, 1997

Related U.S. Application Data

[60] Provisional application No. 60/033,523, Dec. 18, 1996.

[51] Int. Cl.[7] ..... H01P 5/18

[52] U.S. Cl. ..... 333/247; 257/664

[58] Field of Search ..... 333/246, 247; 257/664

[56] References Cited

U.S. PATENT DOCUMENTS 4,875,087 10/1989 Miyauchi et al. ..... 333/247 X 5,097,232 3/1992 Stopper ..... 333/246 X 5,309,122 5/1994 Cox et al. ..... 333/246 X 5,428,327 6/1995 Bahl ..... 333/246

*Primary Examiner*—Justin P. Bettendorf

*Attorney, Agent, or Firm*—Christopher L. Maginniss; W. James Brady III; Richard L. Donaldson

[57] ABSTRACT

An ultrawide bandwidth z-axis interconnect which has a z-axis lap joint structure with embedded ground planes that self compensate for the interface misalignment and impedance mismatch. The structure acts as a low pass filter that can be tailored to meet performance requirements from DC to in excess of 100 GHz. The area required for the interface is reduced while increasing the alignment tolerance range. The interconnect structure is easily modeled as a multi-element low pass filter with interfacing transmission lines (microstrip or stripline) to allow for rapid design efforts and reduction in cycle time for a program.

12 Claims, 1 Drawing Sheet

F VIA*= Z AXIS INTERFACE

ULTRAWIDE BANDWIDTH Z-AXIS INTERCONNECT

This application claims priority under 35 USC 119(e)(1) of provisional application number 60/033,523 filed Dec. 18, 1996.

BACKGROUND OF THE INVENTION

1. Field of the Invention

This invention relates to a z-axis interconnect and, more specifically, to an interconnect for high frequency signals between adjacent locations, such as, for example, circuit boards, semiconductor devices and the like.

2. Brief Description of the Prior Art

It is well known that the transmission of high frequency signals, such as, for example, between two components, such as, for example, between a circuit board and a pad on a semiconductor chip secured thereon, is adversely affected by misalignment of the interconnect structure between the pad and board and impedance mismatch between the pad and board. Such misalignment causes impedance mismatches leading to reflections of microwave signals at the interface and high insertion loss through the interface. Accordingly, in order to insure high quality performance of the equipment, great care must be taken to insure proper alignment of the interconnect structure with the components being interconnected. The present options are (1) to fabricate equipment, taking precautions to control misalignment on a cost/benefit basis, this approach often resulting in low yield and/or poor quality or (2) taking great care to insure proper alignment, this being a tedious and time consuming operation which greatly increases the cost of fabrication on a per unit basis. In general, prior art interconnects derive substantial inductance in vias which are not referenced to a ground plane and minimal capacitance mainly from pad structures. It is therefore difficult to alter the electrical characteristics once mismatch has occurred due to misalignment. Typical prior art systems of the type discussed above are disclosed in D. Strack et al., "Solder Free Interconnects for Mixed Signal (DC/Microwave) Systems", 1996 *IEEE International Microwave Symposium*, pp. 231–234, R. Sturdivant et al., "Transitions and Interconnects Using Coplanar waveguide and Other Three Conductor Transmission Lines", 1996 *IEEE International Symposium*, pp. 235–238 and F. Colomb et al., "Characterization of Metal on Elastomer Vertical Interconnections", 1996 *IEEE International Symposium*, pp. 75–77.

It is therefore apparent that a new and/or improved technique for controlling misalignment and/or the results thereof in high frequency interconnects which can provide high quality and yield and also minimize costs is highly desirable.

SUMMARY OF THE INVENTION

The problem of misalignment is substantially mitigated in accordance with the present invention and there is provided an ultrawide bandwidth z-axis interconnect structure which is substantially insensitive to adverse effects resulting from misalignment within a predetermined window and which is capable of adjustment after fabrication.

Briefly, there is provided a lap joint structure connected with z-axis with embedded ground planes that maintain a transmission line structure for the interface, the lap joints open stubs self compensating for misalignment and impedance mismatch. The structure acts as a low pass filter that can be tailored to meet performance requirements from DC to in excess of 100 GHz. The area required for an interface is reduced while increasing the alignment tolerance range. The interconnect structure is easily modeled as a multi-element low pass filter with interfacing transmission lines (microstrip or stripline). This allows for rapid design efforts, thereby reducing the cycle time for a program.

The improved bandwidth allows for broader applications of the interface and causes less loss to the high frequency signals than in prior art interconnects. Behavior of the signals passing through the interface is easily predicted by keeping the transmission line in close proximity to the embedded ground plane. The alignment compensated structure allows for more alignment tolerance to be given to the assembly, the extra tolerance greatly simplifying the assembly process. The interconnect or interface behaves as a low pass filter that can be designed for ultra wide bandwidth operation and also can be tuned for a desired frequency response (signal rejection or transmission) in various types of assemblies such as ball grid arrays, flip chip assemblies, multi-layer substrates and connector interfaces. Also, the interconnect structure in accordance with the present invention can be adjusted for frequency of operation by adjustment of the geometry of stubs in the interconnect structure as well as adjustment of the interconnect structure itself (i.e., dielectric constants of printed circuit boards, material layer thicknesses).

In accordance with the present invention, there is provided an ultrawide bandwidth z-axis interconnect structure which is substantially insensitive to misalignment within a predetermined window and which is capable of adjustment after fabrication. An electrical circuit including the interconnect includes a multilayered printed wiring board having a first electrically conductive layer having a first rectangular finger portion and a ground plane spaced from, embedded in and substantially parallel to the first electrically conductive layer forming a transmission line. A material is coupled to the first electrically conductive layer which has an electrically conductive component in a direction normal to the first layer and preferably has a non-electrically conductive component in other directions. A preferred material is 3M 5303R Z-Axis Adhesive Film (ZAF) which is a highly cross-inked cured adhesive creep-resistant thermoset material. A second rectangular electrically conductive layer is coupled to the previously mentioned material and spaced from the first electrically conductive layer, the sides of the first rectangular finger portion being either substantially parallel to or substantially normal to the sides of the second rectangular layer. A component such as, for example, a semiconductor chip having a pad thereon, is coupled to the second layer. The circuit also includes a transmission line embedded in the board and an electrically conductive element coupling the transmission line and first layer which is disposed substantially normal to the transmission line and first layer. A ground plane is disposed in the board, spaced from and extending substantially parallel to the transmission line. A microstrip is coupled to the pad and extends between the pad on the chip and the material, and a ground plane is spaced from the microstrip and is coupled to a ground plane in the board via the material.

DESCRIPTION OF THE PREFERRED EMBODIMENT

Figure 1A:
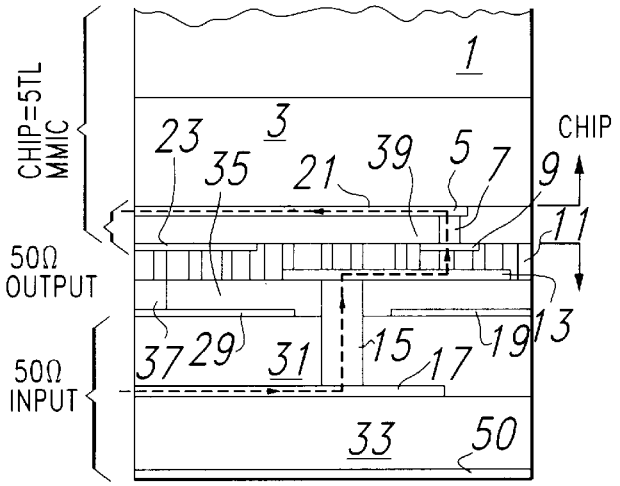
FIG. 1*a* is a side view of a wideband z-axis interconnect in accordance with the present invention.
Figure 1B:
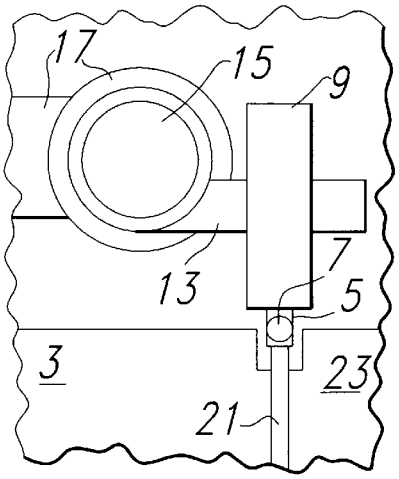
FIG. 1*b* is a top view of the interconnect of FIG. 1*a;*

Referring to FIGS. 1*a* and 1*b*, there are shown side and top views respectively of a wideband z-axis interconnect in accordance with the present invention which is essentially a low pass filter. There is shown a printed wiring board which contains multiple layers including a bottom ground plane 50 resting on electrical insulator section 33, a stripline 17 buried between electrical insulator sections 31 and 33 and ground planes 19 and 29 disposed on the insulator section 31 and spaced from an embedded microstrip line 13 resting on the board surface by electrical insulator section 35. A via with an electrical conductor 15 therein couples stripline 17 to embedded microstrip line 13 and a via with electrical conductor 37 couples ground plane 29 to ground plane 23 via the z-axis material 11. The z-axis material 11 also couple the embedded microstrip line 13 to an embedded transmission line (ETL) 9 with ground plane 23 which is coupled to a pad 5 and microchip 3 through a via in electrically insulating polymer layer 39, the via having electrical conductor 7 therein. The pad 5 is coupled to an embedded transmission line 21 resting on the active surface of the microchip 3 and spaced from ground plane 23 by the polymer layer 39. The chip 3 is embedded in a lossy encapsulant 1 in standard manner.

It should be noted that in standard design techniques, the layers 13 and 19 are in the same plane. However, by having the layer 13 spaced from the layer 19 with a dielectric layer 35 therebetween, layer 13 is converted into an embedded microstrip line. It follows that the signal is always traveling along conductor elements which contact each other and are closely spaced from a ground plane. The interconnect is maintained as a transmission line by maintaining the ground close to the signal line. As the ground layer is farther removed from the signal line, the inductance increases, thereby rejecting high frequency signals since the impedance of the transmission line is $Z=(L/C)^{1/2}$ and the capacitance decreases.

Figure 2:
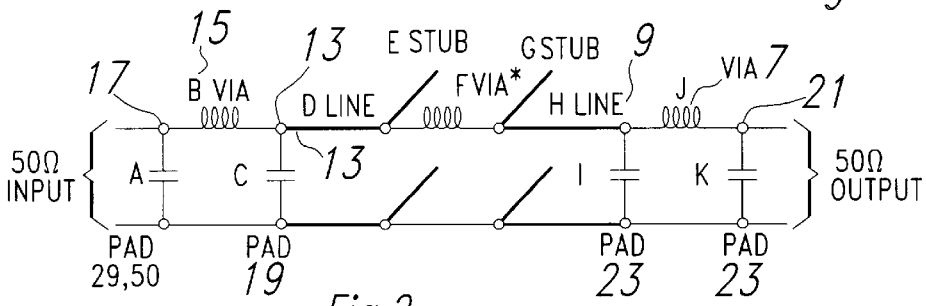
FIG. 2 is a circuit diagram of the interconnect structure of FIGS. 1*a* and 1*b*.

In operation and with additional reference to FIG. 2, an input signal is provided along the 50 ohm input (the input impedance, which is adjustable and is a function of the width of line 17 and the dielectric constant and thickness of regions 31 and 33 is a matter of choice and is generally 50 ohms) across the stripline 17 and ground plane closely spaced therefrom at ground planes 29 and 50. The input travels along conductor 15 which is also closely spaced from ground planes 19 and 29 to embedded microstrip line 13 which is also closely spaced from ground plane 19 to provide capacitor A between the ground plane 29,50 and stripline 17 and inductor B comprising the conductive path including stripline 17 and conductor 15 in the via. The capacitor C is provided between the conductor 15 and the ground plane pad 19, capacitors A,C and inductor B forming a first low pass filter section. The line D is a portion of the embedded microstrip line 13 with the stub E being the portion of embedded microstrip line 13 extending over the ground plane pad 19. The inductor F is formed from the z-axis material 11 between embedded microstrip line 13 and embedded transmission line (ETL) line 9, which is a microstrip line with the stub G being the portion of EML line 9 extending laterally beyond the via containing conductor 7. The capacitor I is provided between the ETL line 9 and the ground plane pad 23 with inductor J being the path from conductor 7 including pad 5 on the chip 3 and the conductor 21 on the face of the chip and beneath the polymer layer 39. The capacitor K is provide d between the conduct or 21 and the ground plane pad 23. As can be seen, capacitors I,K and inductor J provide a fifth low pass filter section. The output is taken across the capacitor K.

Figure 3:
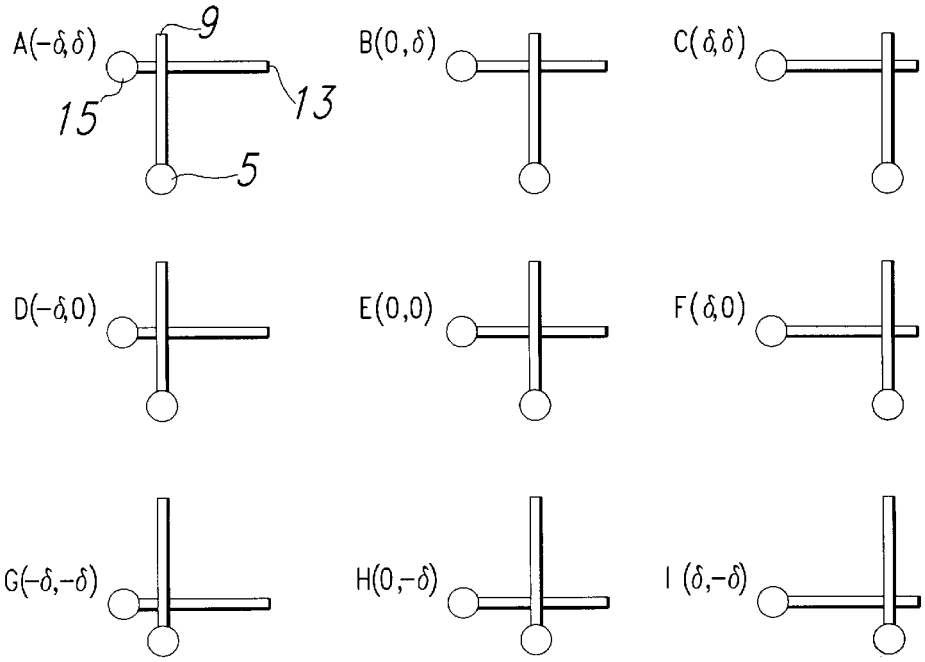
FIG. 3 is a schematic diagram showing the alignment possibilities between the embedded transmission line 9 and the transmission line 13 of FIGS. 1*a*, 1*b* and 2.

It can be seen from the above described circuitry of FIGS. 1*a*, 1*b* and 2 that a critical feature of the interconnect structure is the alignment between the layers 9 and 13. In order to avoid any changes in electrical properties with misalignment, it is necessary that the capacitance between the layers 9 and 13 remain constant with changes in alignment. With reference to FIG. 3, assuming a 50 $\mu$m alignment range and with alignment possibility E representing ideal alignment, the circles labeled 5 and 15 correspond to the pad and conductor regions of like number and striplines 9 and 13 correspond to striplines of like number in FIGS. 1*a* and 1B, all of the possible alignment (misalignment) possibilities A to I being shown wherein $\delta$ stands for position shift from the ideal/perfect alignment (delta x). It can be seen that the overlap of striplines 9 and 13 remains constant and, with the signal travelling from pad 5 to line 15 or vice versa, the lengths of the striplines from pad to other stripline change whereas the stub lengths of each stripline from junction of stripline to end of stripline also change. With other dimensions remaining constant, as stripline length increases, both the inductance and capacitance increase and as the stripline length decreases, both the inductance and capacitance decrease. Without a ground plane closely spaced from the signal line, only the inductance would be affected with change in stripline length with capacitance being affected to a much smaller degree, depending upon the spacing of the signal line from the ground plane. The stubs, meanwhile, can be used as tuning elements to provide shunt capacitance and ease of alignment and adjust the operating frequency of the interconnect. The cutoff of the interconnect can be changed by adding and/or subtracting inductance and/or capacitance.

Though the invention has been described with reference to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A z-axis interconnect comprising:

(a) a multilayered device having a first electrically conductive layer having a first rectangular finger portion and a ground plane spaced from and substantially parallel to said first electrically conductive layer forming a transmission line;

(b) a material having a plurality of adjacent conductor paths coupled to said first electrically conductive layer which is electrically conductive in a direction normal to said first layer and substantially non-electrically conductive in directions not normal to said first layer; and (c) a second rectangular electrically conductive layer coupled to said material and spaced from said first electrically conductive layer, the sides of said first rectangular finger portion being at an angle with respect to the sides of said second rectangular layer which is neither acute nor obtuse.

2. The interconnect of claim 1 wherein said multilayered device is a printed wiring board.

3. The interconnect of claim 1 wherein said second layer is an embedded transmission line.

4. The interconnect of claim 3 wherein said multilayered device is a printed wiring board.

5. An electrical circuit which comprises:

(a) a multilayered printed wiring board having a first electrically conductive layer having a first rectangular finer portion and a ground plane spaced from and substantially parallel to said first electrically conductive layer forming a first transmission line;

(b) a material having a plurality of adjacent conductor paths coupled to said first electrically conductive layer which is electrically conductive in a direction normal to said first layer and substantially non-electrically conductive in directions not normal to said first layer;

(c) a second rectangular electrically conductive layer coupled to said material and spaced from said first electrically conductive layer, the sides of said first rectangular finger portion being either substantially parallel to or substantially normal to the sides of said second rectangular layer; and (d) a semiconductor chip having a pad thereon coupled to said second layer.

6. The circuit of claim 5 further including a second transmission line embedded in said board and an electrically conductive element coupling said second transmission line and said first layer and disposed substantially normal to said second transmission line and said first layer.

7. The circuit of claim 6 further including said ground plane disposed in said board, spaced from and extending substantially parallel to said transmission line.

8. The circuit of claim 7 further including a microstrip coupled to said pad and extending between said chip and said material, said ground plane spaced from said microstrip and coupled to a ground plane in said board via said material.

9. The circuit of claim 6 further including a microstrip coupled to said pad and extending between said chip and said material, said ground plane spaced from said microstrip and coupled to a ground plane in said board via said material.

10. The circuit of claim 5 further including said ground plane disposed in said board, spaced from and extending substantially parallel to said transmission line.

11. The circuit of claim 10 further including a microstrip coupled to said pad and extending between said chip and said material, said ground plane spaced from said microstrip and coupled to a ground plane in said board via said material.

12. The circuit of claim 5 further including a microstrip coupled to said pad and extending between said chip and said material, said ground plane spaced from said microstrip and coupled to a ground plane in said board via said material.

* * * * *